US005873698A

United States Patent [19]

Thalmann

[11] Patent Number: 5,873,698

[45] Date of Patent: Feb. 23, 1999

[54] CENTRIFUGAL PUMP

[76] Inventor: William H. Thalmann, 5575 Bia Marina, Clarence, N.Y. 14221

[21] Appl. No.: 827,098

[22] Filed: Mar. 17, 1997

[51] Int. Cl.[6] ..... F04D 29/44

[52] U.S. Cl. ..... 415/174.3; 415/170.1

[58] Field of Search ..... 415/170.1, 174.2, 415/174.3, 174.4, 204, 206, 200

[56] References Cited

U.S. PATENT DOCUMENTS

| | | | |
|---|---|---|---|
| 1,369,508 | 2/1921 | Weiner et al. | 415/174.2 |
| 1,525,884 | 2/1925 | Plummer | 415/174.2 |
| 1,715,944 | 6/1929 | Oliver | 415/174.2 |
| 1,783,427 | 12/1930 | Jennings | 415/174.3 |
| 2,869,471 | 1/1959 | Copeland | 415/174.2 |
| 3,510,230 | 5/1970 | Raub | 415/174.2 |
| 3,826,589 | 7/1974 | Frank et al. | 415/174.3 |
| 4,245,952 | 1/1981 | Eberhardt | 415/170.1 |
| 4,720,242 | 1/1988 | Lovisetto | 416/186 A |
| 4,909,707 | 3/1990 | Wauligman et al. | 415/170.1 |
| 4,948,336 | 8/1990 | Mosure | 415/174.2 |
| 5,295,786 | 3/1994 | Kajiwara | 415/173.3 |

*Primary Examiner*—John T. Kwon
*Attorney, Agent, or Firm*—Crossetta & Associates

[57] ABSTRACT

An improved centrifugal pump is disclosed comprising a slip ring arranged around a central opening of a guidevane proximate the intake conduit shoulder of an impeller which is positioned, dimensioned and formed from a material sufficient to creat a lamellar interface between fluid movement on either side of the guidevane which retards the abrading effect of sheering forces at a point of critical clearance among the guidevane and the rotating impeller conduit shoulder.

18 Claims, 2 Drawing Sheets

CENTRIFUGAL PUMP

The invention relates to centrifugal pumps and more particularly to an improved arrangement for reducing wear between moving parts and extending the life of a centrifugal pump.

BACKGROUND OF THE INVENTION

Centrifugal pumps generally comprise an impeller, which is rotatably mounted in a stationary casing, the rotating impeller imparting pressure and kinetic energy to the fluid being pumped, and the stationary casing guiding the fluid to and from the impeller. The fluid is caused to flow in a generally circular direction about the perimeter of the casing by means of a guidevane which directs fluid exiting the impeller to a discharge nozzle of the pump.

In the operation of centrifugal pumps of such nature, the fluid flow is generally effected by the design and size of the impeller, the design and size of the casing and guidevane, the speed at which the impeller rotates, the design and size of the pump inlet and outlet, quality of finish of the components and the like.

In a popular commercially available centrifugal pump arrangement the pump is an assembly of multiple stamped metal parts. A base mounting plate is mounted nearest the motor and comprises a generally central opening through which a shaft from the motor extends for mounting of an impeller. A seal is mounted at the central opening of the base plate between the motor shaft and the base plate to resist reverse flow of fluids from the pump along the shaft.

A generally circular pump casing is mounted and sealed to the base plate, which together therewith enables a sealed housing containing a motor shaft driven impeller assembly, a guidevane (diffuser), inlet and outlet of the pump.

The impeller may comprise a fabricated assembly or may be molded, machined or otherwise formed from a single billet of material. In a particularly popular embodiment, whether molded from a billet or assembled, the impeller can be generally described as comprising opposing circular front and rear impeller plates, which contain therebetween vents which radiate from a central fluid intake opening in the impeller to the periphery of the impeller.

The impeller assembly is mounted to the shaft of the motor to rotate therewith, generally by means of a threaded mount which is positioned along about the center axis of the impeller spaced rearward toward the motor from the rear impeller plate to enable flow of fluid through the central intake opening past the front impeller plate through the radiating vents and out the periphery of the impeller. The front plate of the impeller further comprises a raised cylindrical shoulder (nose) which extends forward from the plate toward the inlet of the casing to enable a conduit for fluid flow from the inlet of the pump casing to the central opening of the impeller.

A guidevane, or diffuser, is generally press fit mounted to the interior of the casing and generally divides the casing among a rearward impeller section comprising the area from the base mounting plate to the guidevane and a forward outlet section comprising the area from the guidevane to the outlet. The guidevane generally comprises a dished circular plate with tangentially streamlined flow directors comprising openings along its perimeter. The flow directors are arranged to extend over the periphery of the impeller and direct fluid passing through the vanes of the rotating impeller, into the forward outlet section of the casing, in a stream circulating around the rounded interior of the wall of the casing. The design and placement of the guidevane is critical to achieving and maintaining a particular flow design of the circulating pump and constitutes an operational seal among the differential pressures between the impeller section and the outlet section.

The guidevane has an impeller opening to enable it to be mounted over an inlet conduit. The inlet conduit provides influent to the central opening of the impeller and generally comprises a conduit means extending from an opening in the casing of the pump to the cylindrical shoulder/nose of the impeller arranged about the impeller's central opening. Fluids in the inlet conduit are generally under a negative pressure in that the impeller sucks fluid therein. The impeller opening of the guidevane is critically sized to enable rotation of the shoulder of the forward plate of the impeller without engaging the edge of the impeller opening of the guidevane, but to a close tolerance to maintain an operational seal between the impeller section and the outlet section and may even include an operational seal among the inlet conduit, the outlet section and/or the impeller section.

Pumps of the above arrangement have manufacturing and assembly advantages in that the components can be conveniently produced from stamped thin metals and easily assembled with minimum skill. However, such arrangement has been found to have inherent failure problem. As the guidevane is stationary and the impeller rotating, the operational seal between the components typically involves maintaining a critical close tolerance impeller opening which enables impeller rotation without significant flow of fluids through the impeller opening between the guidevane and the shoulder of the impeller. Typical low cost metal stamping processes make it difficult to maintain close tolerances. Since the efficiency of the pump generally requires the maintenance of differential pressures at the operational seal, factors which may contribute to degradation of the operational seal may effect efficiency and pump life, involving costly down time and repair costs.

Fluids pumped in such arrangements characteristically are subject to significant lamellar flow sheering forces along the shoulder of the impeller forward plate particularly at about the critical operational seals and thus, can exacerbate degradation of operational seals. In utilities wherein particulate containing materials and/or fluid mixtures are being pumped, the lamellar sheering forces can degrade the material comprising the impeller and/or the edge of the impeller opening of the guidevane, beyond the design limits of the operational seal.

Various means have been tried to prevent the failure of operational seals. One means is to mount a metal or the like "O" ring seal on the collar of the impeller and maintain a critical tolerance among it and the guidevane impeller opening. However, such seals tend to be loose or loosen from the collar during operation of the pump and upon loosening have been known to cut through the collar and create further repair problems. In addition, the thin metals used in popular guidevanes can flex and otherwise distort during operation so that critical tolerances can be elusive. No satisfactory method of resolving the problem appears to have been found.

It is an object of the present invention to provide an improved seal among the critical tolerance at the guidevane impeller opening and the impeller shoulder.

It is a further object of the invention to provide an improved circular pump having longer wear characteristics.

These and other objects of the invention will become apparent from the following.

SUMMARY OF THE INVENTION

The present invention provides an improvement to circulating pumps which contain thin stamped metal guidevanes and/or impeller shoulders/noses as aforedescribed, by the incorporation of a specifically constructed slip ring at the impeller opening of a guidevane of a circulating pump, arranged to maintain the operational seal and dissipate the degrading effects of lamellar sheering forces along the operational seal among the impeller opening of the guidevane, the impeller collar and/or the intake conduit.

It is believed that in the operation of a circulating pump as above described, the high speed rotation of the impeller carries a rotating layer of fluid along the front surface of the impeller between the body of the guidevane, which extends from the perimeter of the impeller down to the critical sized space between the impeller opening of the guidevane and the shoulder. On the other side of the thin guidevane, in the outlet section of the casing, fluid flow is generally circular around the periphery of the interior surface of the casing with fluid flow decreasing the nearer the central axis of the guidevane. The result is that the circular flow of fluid in the outlet section of the pump at about the critical space between the guidevane and the shoulder is different than the circular flow of fluid in the impeller section at about the area of the critical space.

It is believed that because of such differential in flow of fluids among the two sections at about the critical space between the edge of the impeller opening of the guidevane and the shoulder of the impeller, that lamellar sheer forces between the moving fluid in the impeller section and the moving fluid in the outlet section is particularly high. Since the edge of the impeller opening of the guidevane is positioned along this particularly high lamellar sheer point, the edge may be subject to flexion, heat and/or abrading effects of the sheering forces. If the guidevane is stamped from a thin metal as preferred for manufacturing convenience, the resulting thin edge may be distorted and/or abraded along the edge and thus, the impeller opening of a guidevane is particularly susceptible to failure of the operational seal.

The slip ring of the present invention is arranged to encircle the shoulder/nose of the impeller at about the impeller opening of the guidevane, and move an area of sheer occurrence between the disparate moving fluids to a position spaced from the edge of the guidevane by promoting fluid sheer through decreasing resistance. To achieve this the slip ring comprises a ring of low coefficient of friction material, arranged to encircle the shoulder/nose of the impeller, having an inner diameter which is generally flat so as to maintain an encircling generally flat surface opposite a generally mating flat surface of the generally cylindrical nose/shoulder of the impeller. Such arrangement creates a critical spaced corridor between the impeller and the interior diameter of the ring, preferably having a minimum depth of about 1/16 inch.

The slip ring of the invention is fixed or loosely mounted at about the wall comprising the edge of the guidevane, encircling the impeller opening in such manner as to provide a walled channel of slippery material at the opening. It is believed that such mounting of the slip ring moves the position of sheer between the lamellar sheering fluids to a point adjacent the material comprising the slip ring and away from the edge of the material comprising the guidevane. It is believed that such channel having a defining wall which is comprised of a material having a low coefficient of friction dissipates the effects of lamellar sheer by reducing heat and abrasion and prolongs the life of the pump and may improve the efficiency thereof.

To promote sheer, the slip ring is constructed of a slippery material, e.g. a material which has a smaller coefficient of friction and is less resistant to passage of the fluid thereover than the material from which the guidevane is constructed. Thus, the slip ring of the present invention is comprised of a material containing Teflon, Nylon, Viton, CPVC, Buna-N, or the like.

In a preferred embodiment the slip ring is mounted to the guidevane at about the impeller opening to be maintained stationary with respect to the rotation of the impeller.

The nature, principles and details of the invention as well as other objects and features thereof, will be more clearly apparent from the following description taken in connection with the accompanying drawings in which like parts are designated by like reference characters.

DETAILED DESCRIPTION OF THE INVENTION

Figure 1:
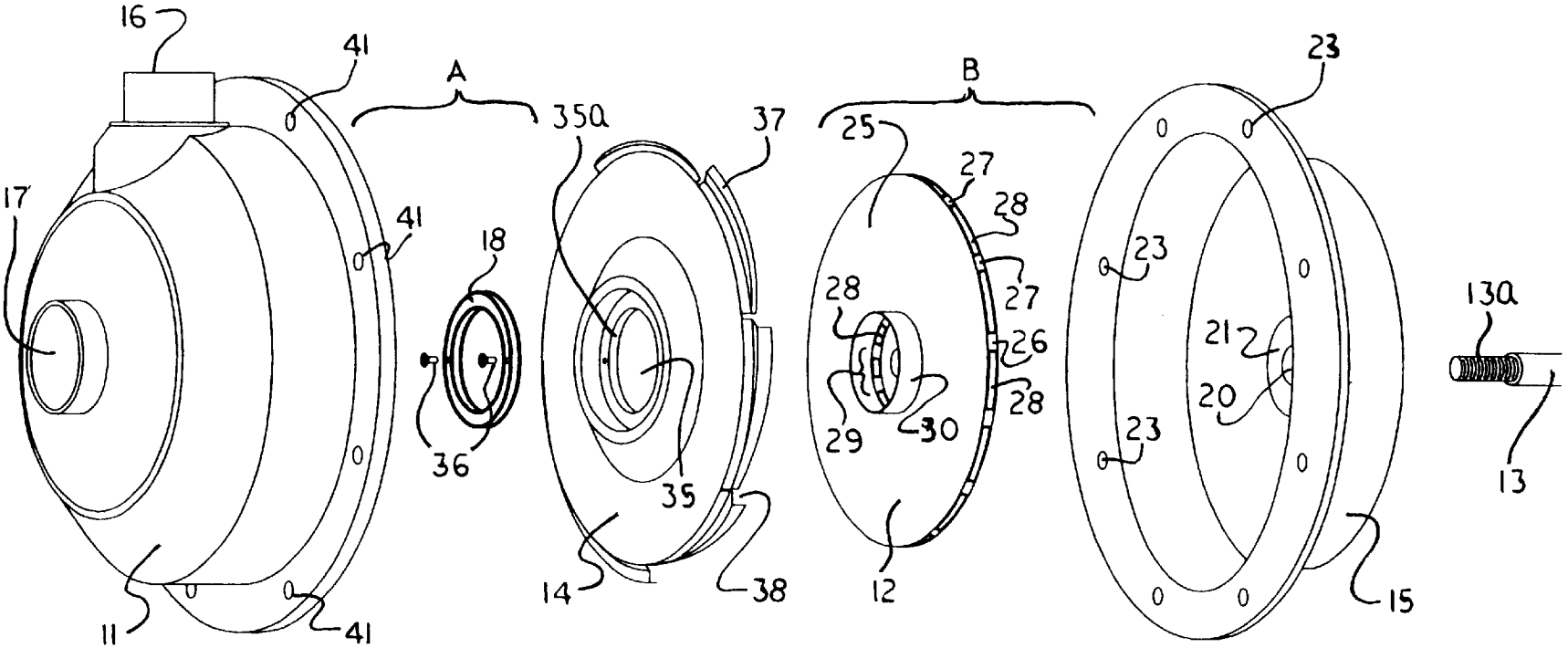
FIG. 1 is an exploded perspective view of a centrifugal pump assembly of the invention.
Figure 2:
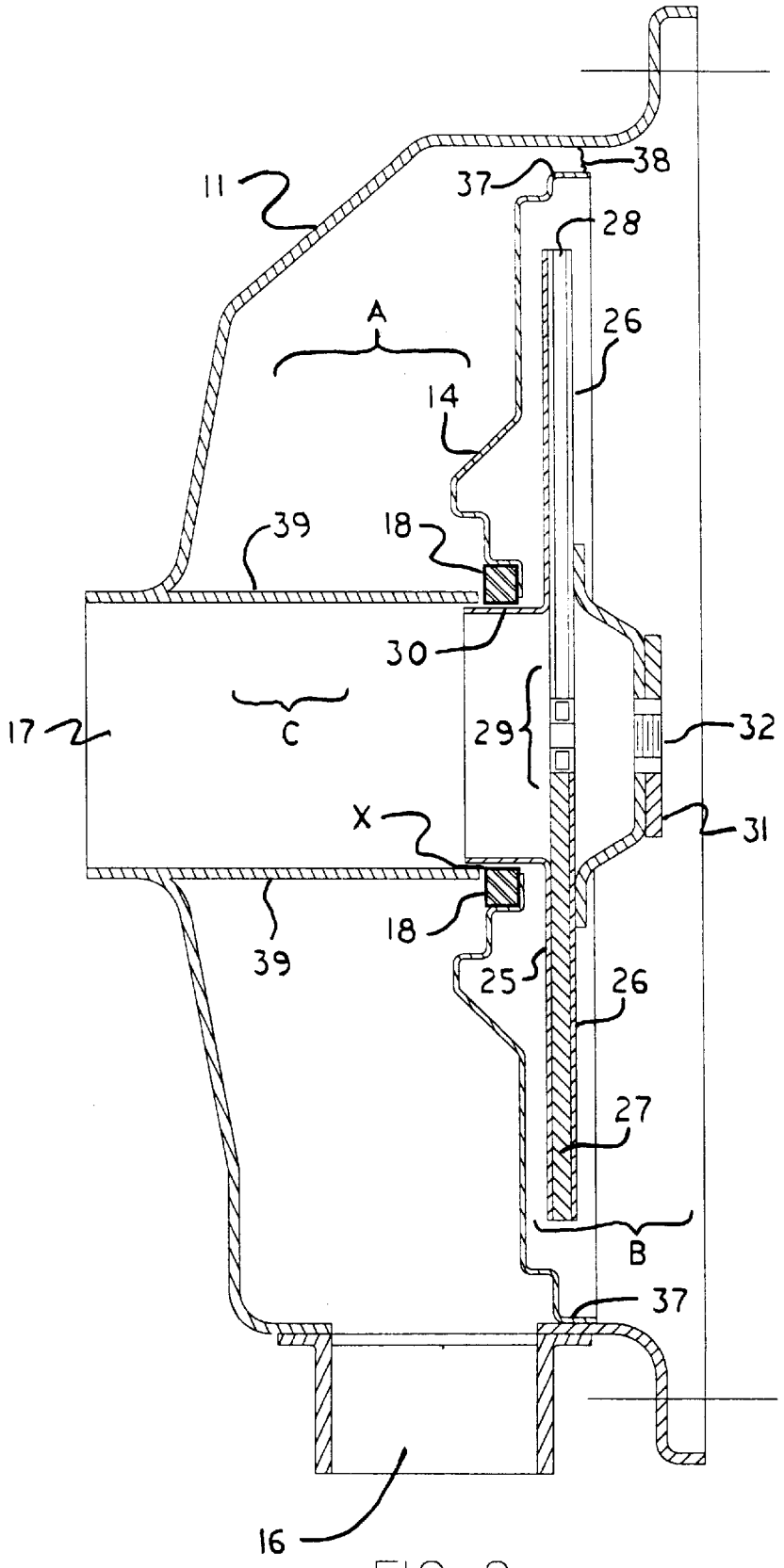
FIG. 2 is a sectional view of an assembled pump of the invention.

Referring to FIGS. 1 and 2, therein is shown a centrifugal pump comprising pump casing 11, impeller assembly 12, impeller drive shaft 13 which is connected to a drive motor (not shown), guidevane 14, impeller casing 15, pump discharge outlet 16, pump inlet 17 and slip ring 18.

Impeller casing 15 comprises a central hole 20, which is surrounded by seal 21 through which shaft 13 extends, the seal preventing leakage along shaft 13 to the motor. Impeller casing 15 comprises mounting means, not shown, arranged for mounting a drive motor which drives shaft 13. Holes 23 are provided to enable bolt mounting through mating holes 41 of pump casing 11. Alternately, though not shown, a suitable gasket or the like may be positioned between casing 11 and impeller casing 15.

Impeller 12, is illustrated as a fabricated assembly comprising front plate 25, rear plate 26 and vanes 27 which form openings 28 which extend from the central opening 29 to the periphery of the impeller. Shoulder 30 extends from front plate 25 forward. FIG. 2 illustrates the means by which the impeller is mounted to shaft 13, comprising a dished back female threaded cup mount 31 attached along the central axis of impeller 12 to rear plate 26. Shaft 13 is threaded at 13*a* to engage a mating female threaded hole 32 in mount 31.

Guidevane 14 is illustrated as being constructed from a press formed plate and comprising an impeller opening 35, which is sized to fit around shoulder 30 of impeller 12 enabling the impeller shoulder to rotate without engaging the edge 35*a* of the opening. Slip ring 18 is illustrated as mounted around opening 35 by means of screws 36. In the illustrated embodiment, the opening formed by slip ring 18 is smaller than opening 35 and is sized to the critical design tolerance for flow of fluids between the impeller side and the outlet side of the casting. Guidevane 14 comprises tangentially streamlined flow directors 37 which extend over and along its perimeter, and the perimeter of the impeller assembly, to form openings 38 in the periphery to direct fluid passing through the vanes of the rotating impeller in rearward section B to forward section A of the casting. Wall 39 forms the inlet conduit which provides an operational seal X among section C of the inlet conduit and sections A and B.

I claim:

1. In a centrifugal pump comprising a rotating impeller arranged for receiving fluid to be pumped through a central opening therein which is surrounded by a generally cylindrical shoulder, and a guidevane having an opening arranged to encircle said cylindrical shoulder at a critical clearance, the improvement comprising; said guidevane having flow directors arranged along about its periphery to guide fluid being pumped by said imnpeller from an impeller output section of said pump, through openings at the periphery of said guidevane, to an outlet section of said pump, mounting a slip ring to said guidevane opening arranged to encircle said cylindrical shoulder, said slip ring comprising a surface having a coefficient of friction less than that of the material comprising said guidevane.

2. The improved centrifugal pump of claim 1 wherein said slit ring has an inner surface sized to form a spaced corridor between the inner diameter of said slip ring and said cylindrical shoulder, and said corridor is of a depth sufficient to create a lamellar interface between a fluid moving at a first speed on one side of said guidevane and a fluid moving at another speed on another side of said guidevane in a plane along the depth of said corridor.

3. The improved centrifugal pump of claim 1 wherein said slip ring is mounted to said guidevane by screw attachment.

4. The improved centrifugal pump of claim 1 wherein said slip ring is press fitted to said opening of said guidevane.

5. The improved centrifugal pump of claim 1 wherein said slip ring is loosely mounted about said shoulder of said impeller.

6. The improved centrifugal pump of claim 1 wherein said slip ring comprises a surface formed from a material selected from Teflon, Nylon, Viton, CPVC, Buna-N and the like.

7. An improved centrifugal pump comprising, a slip ring, arranged around an opening of a guidevane proximate a generally cylindrical intake conduit shoulder of an impeller, said guidevane having flow directors arranged along about its periphery to guide fluid being pumped by said impeller from an impeller output section of said pump through openings at the periphery of said guidevane to an outlet section of said pump, said slip ring having a surface comprising a material having a lower coefficient of friction than the material comprising said impeller, and having an inner diameter comprising a generally cylindrical inner surface in mating arrangement around said shoulder so as to enable a spaced corridor between said shoulder and said inner surface of said ring.

8. The improved centrifugal pump of claim 7 wherein said slip ring is dimensioned and positioned to enable a lamellar interface between disparate fluid movement on either side of said guidevane adjacent said lower coefficient of friction surface.

9. A process for improving the wear resistance of a centrifugal pump comprising, arranging a guidevane to guide fluid pumped by an impeller through openings at about the periphery of the guidevane from an impeller output section of said pump to an outlet section of said pump, mounting a slip ring around an opening of said guidevane proximate an intake conduit shoulder of said impeller to enable a spaced corridor between the inner diameter of the slip ring and said shoulder, said slip ring being positioned, dimensioned and comprising a surface sufficient to create a lamellar interface between disparate fluid movement on either side of said guidevane.

10. The process of claim 9 wherein slip ring enables the dissipation of sheering forces at about a point of critical clearance among the guidevane and said conduit shoulder of said impeller.

11. The process of claim 9 wherein said slip ring is mounted to said guidevane by screw attachment.

12. The process of claim 9 wherein said slip ring is press fitted within said opening of said guidevane.

13. The process of claim 9 wherein said slip ring is loosely mounted to said shoulder.

14. The process of claim 9 wherein said slip ring is formed from a material selected from Teflon, Nylon, Viton, CPVC, Buna-N, and the like.

15. An improved centrifugal pump comprising a slip ring, arranged around an opening of a guidevane proximate a generally cylindrical intake conduit shoulder of an impeller, said guidevane arranged to guide fluid pumped by an impeller from an impeller output section through openings at about the periphery of said guidevane to an outlet section of said pump, said slip ring having an inner diameter comprising a generally cylindrical inner surface in mating arrangement around said shoulder so as to enable a spaced corridor between said shoulder and said inner surface of said ring, which corridor has a depth sufficient to enable a lamellar interface between disparate fluid movement on opposite sides of said corridor.

16. An improved centrifugal pump of claim 15 wherein said depth of said inner surface is about 1/16th inch or greater.

17. An improved centrifugal pump of claim 16 wherein said slip ring is loosely mounted to said shoulder.

18. The process of claim 9 wherein said slip ring is dimensioned to enable a corridor depth of about 1/16th inch or greater.

* * * * *